US005227084A

United States Patent [19]

Martens et al.

[11] Patent Number: 5,227,084

[45] Date of Patent: Jul. 13, 1993

[54] CONCENTRATED DETERGENT POWDER COMPOSITIONS

[75] Inventors: Rudolf J. Martens, Vlaardingen; Ton Swarthoff, Hellevoetsluis; Marten R. P. Vliet van, Haarlem, all of Netherlands

[73] Assignee: Lever Brothers Company, Division of Conopco, Inc., New York, N.Y.

[21] Appl. No.: 869,587

[22] Filed: Apr. 16, 1992

[30] Foreign Application Priority Data

Apr. 17, 1991 [GB] United Kingdom ..... 9108136.4

[51] Int. Cl.[5] ..... C11D 3/395; C11D 3/04; C11D 7/04

[52] U.S. Cl. ..... 252/95; 252/174.12; 252/99; 252/186.39; 252/186.33; 252/186.4; 252/186.41; 502/152; 502/150; 502/167

[58] Field of Search ..... 252/186.29, 186.40, 252/186.41, 186.21, 186.39; 502/167, 150

[56] References Cited

U.S. PATENT DOCUMENTS 4,728,455 3/1988 Rerek ..... 252/99
5,114,606 5/1992 van Vliet et al. ..... 252/103
5,114,611 5/1992 Van Kralingen et al. ..... 252/186.33
5,153,161 10/1992 Kerschner et al. ..... 502/167

FOREIGN PATENT DOCUMENTS 0369841 5/1990 European Pat. Off. .

OTHER PUBLICATIONS

K. Wieghardt, "Journal of the American Chemical Society", 1988, vol. 110, No. 22, pp. 7298-7410.
"Journal of the Chemical Society-Chemical Communications", 1985, pp. 1145-1146.

*Primary Examiner*—Paul Lieberman
*Assistant Examiner*—Michael Patrick Tierney
*Attorney, Agent, or Firm*—Milton L. Honig

[57] ABSTRACT

Concentrated detergent powder compositions having a bulk density of above 600 g/l, preferably at least 610 g/l, more preferably from 650 g/l to 1200 g/l, and comprising a surfactant, a detergency builder, enzymes, a peroxygen compound bleach, and a manganese complex as effective bleach catalyst are disclosed.

Specifically preferred manganese complexes are:

1) $[Mn^{IV}{}_2(\mu\text{—}O)_3(Me\text{—}TACN)_2](PF_6)_2$ and
2) $[Mn^{IV}{}_{2(\mu\text{—}O)3}(MeMe\text{—}TACN)_2](PF_{6)2}$ Use of these catalysts can make the detergent powder more compact, i.e. reduce the pack volume, without loss of performance or even with a much better bleaching and washing powder.

11 Claims, No Drawings

CONCENTRATED DETERGENT POWDER COMPOSITIONS

TECHNICAL FIELD

This invention relates to concentrated detergent powder compositions. More particularly, the invention relates to improved, concentrated and highly concentrated, also called super-concentrated, heavy duty laundry detergent bleach powder compositions.

BACKGROUND AND PRIOR ART

Recently, considerable interest has been shown within the detergents industry as well as among consumers and sale centers in concentrated to highly concentrated detergent powder compositions having a relatively high bulk density of above 600 g/l, preferably at least 610 g/l. The term "detergent powder compositions" used herein refers to particulate detergent compositions consisting of granules or particles or mixtures thereof, of a size which, as a whole, will have the appearance of a powdered composition. Currently, highly concentrated detergent powder compositions having a bulk density of at least 650 g/l to even above 750 g/l have been commercialized.

The trends, begun in the last year or two, are coming along in the detergents industry, with environmentalism and concentrated detergents going hand in hand.

The advantages of concentrated detergents powder compositions are evident, of which the following are particularly worth mentioning:

(i) smaller containers or packs provide easier handling to the consumer;

(ii) savings in storage and transport costs;

(iii) smaller packs create shelf space for stacking more pack per unit space;

(iv) less packing material will result in less waste to the environment.

For the concentration of powdered detergents and to achieve smaller packs, in principle the following possibilities exist:

using more active components;

avoiding activity losses during the manufacture and storage;

minimizing the amount of or avoiding all non-functional ingredients used in the manufacturing process;

minimizing the amount of air and moisture in the product as well as in the packet.

Non-functional ingredients are ingredients not really essential to the washing performance, particularly sodium sulphate. Minimizing the amount of air in the product and packet can be achieved by densifying and shaping the particles so as to reduce the specific volume of the product, i.e. increasing the bulk density.

Foremost as essential ingredients in the formulation of modern heavy duty detergent compositions are:

a) surface-active agents, which can be anionic, nonionic, cationic or amphoteric in nature;

b) builders for detergency boosting and for binding the Ca/Mg hardness of the water;

c) enzymes, e.g. proteolytic, amylolytic, cellulolytic or lipolytic enzymes or mixtures thereof, particularly proteolytic and lipolytic enzymes;

d) bleaching agents for the removal of bleachable stains.

In addition, the detergent composition may also contain one or more of the following specific functional ingredients, though in small amounts, to give additional benefits for a top quality product, such as optical whitening agents, anti-redeposition agents, polycarboxylate polymers, stabilizers, anti-oxidants, foam-depressing agents, perfume, colouring agents and the like.

The bleach system as now used in concentrated and highly concentrated detergent powder formulations is still the same as that used in conventional powders and consists of a mixture of a peroxygen bleach compound, e.g. sodium perborate mono- or tetrahydrate, particularly the monohydrate, or sodium percarbonate, and a peroxyacid bleach precursor, e.g. tetraacetylethylene diamine (TAED).

Normally, the required level of sodium perborate or other peroxygen compound in such compositions will be from about 10 to 25% by weight, and the peroxyacid bleach precursor, e.g. TAED, is generally present at a level of from about 2 to 10% by weight, making up to a total level of bleach component of from about 12 to 35% by weight of the composition.

It is obvious that any means that could still reduce the pack volume, however small, without affecting the washing power, is most important.

In addition, with the trend towards still lower fabric washing temperatures to e.g. 40° C. and below, there is an incentive to constantly improve on the bleaching performance of TAED/peroxygen compound systems. One option is to replace TAED by a more reactive bleach precursor, though being a peroxyacid bleach precursor, the required level in the composition will still be in the order of about 2–10% by weight.

The present invention relates to the use of a metal-complex bleach catalyst in concentrated and super-concentrated detergent powder compositions.

In contrast to organic peroxyacid bleach precursors, which function by the mechanism of reacting with the peroxygen compound forming the corresponding peroxyacid, bleach catalysts work differently and are effective already in very small amounts.

Many transition and heavy metal complexes have been proposed as peroxide bleach catalysts, but they all suffer from one or more drawbacks for being of practical value, e.g. they are either environmentally less acceptable, of insufficient activity, or of insufficient stability.

Description of the Invention

It has now been found that a concentrated detergent powder composition can still be improved in terms of reducing the pack volume or improving the low-temperature bleach performance, or both, by using a bleach system comprising a peroxygen compound and an effective amount of an active manganese complex as bleach catalyst, without the above drawbacks.

Accordingly, the invention provides a concentrated detergent powder composition having a bulk density of above 600 g/l, preferably at least 610 g/l, comprising:

(a) from 10 to 50%, preferably from 15 to 40% by weight, of a surface-active agent, selected from the group consisting of anionic, nonionic, cationic and amphoteric surfactants, and mixtures thereof;

(b) from 15 to 80%, preferably from 20 to 70% by weight, of a detergency builder or builder mixture;

(c) from 0 to 10%, preferably from 0.001 to 10% by weight, of an enzyme;

(d) from 5 to 35%, preferably from 10 to 25% by weight, of a peroxygen compound, characterized in that the composition further contains from 0.0005 to 0.12%, preferably from 0.001 to 0.05% by weight, of manganese in the form of a manganese complex as bleach catalyst of the following formula:

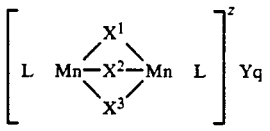

(I)

wherein Mn is manganese, which can be either in the II, III or IV oxidation state; $X^1$, $X^2$ and $X^3$ represent a bridging species selected from O, $O_2$, $HO_2$, OH, ROCOO and RCOO ions and mixtures thereof, with R being H, $C_1$–$C_4$ alkyl; z denotes the charge of the complex which can be positive or negative. If z is positive, Y is a counteranion such as $Cl^-$, $Br^-$, $I^-$, $NO_3^-$, $ClO_4^-$, $NCS^-$, $PF_6^-$, $RSO_3^-$, $RSO_4^-$ or $OAc^-$, wherein R can be H or $C_1$–$C_4$ alkyl; if z is negative, Y is a counter-cation which can be an alkali metal, alkaline earth metal or (alkyl)ammonium cation; q=z/charge Y; and L is a ligand which is an organic compound selected from N,N',N''-trimethyltriazacyclononane (Me-TACN) and its carbon-substituted derivatives having the formula:

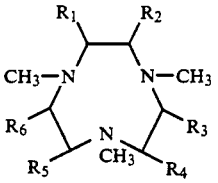

(A)

wherein $R_1$–$R_6$ can each be hydrogen or a $C_1$–$C_4$ alkyl group.

A preferred ligand is that of formula (A) wherein $R_1$–$R_6$ are hydrogen, i.e. N,N',N''-trimethyl-triazacyclononane (Me-TACN).

Another preferred ligand is that of formula (A) wherein one of $R_1$–$R_6$ is methyl, i.e. 1, 2, 4, 7,-tetramethyl-1, 4,7-triazacyclononane (MeMeTACN).

The above-stated manganese levels will roughly correspond with a manganese complex level of from about 0.004 to 1.0%, preferably from 0.008 to 0.4% by weight in the composition.

Preferred complexes are those of formula (I) wherein Mn is $Mn^{IV}$ and wherein $X^1$, $X^2$ and $X^3$ are $O^{2-}$, such as for example:

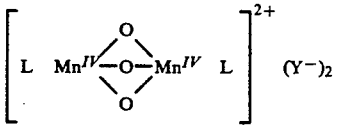

particularly wherein L is Me-TACN and further particularly wherein Y—$PF_6$

Examples of typical manganese complexes usable as bleach catalysts in the present invention are:

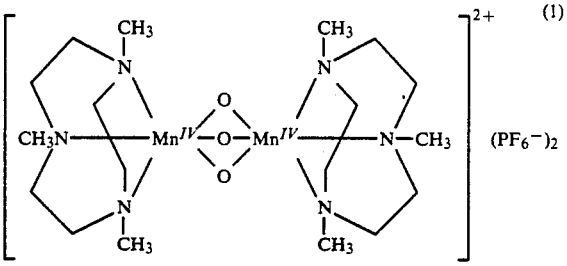

(1)

$[Mn^{IV}_2(\mu\text{-}O)_3(Me\text{—}TACN)_2](PF_6)_2$

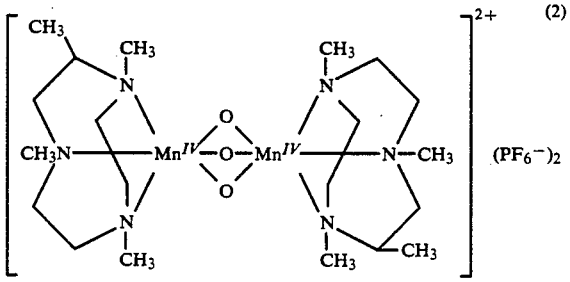

(2)

$[Mn^{IV}_2(\mu\text{-}O)_3(Me\ \ Me\text{—}TACN)_2](PF_6)_2$

The manganese complexes as hereinbefore described are very effective oxidation and bleach catalysts, much more effective than any of the manganese catalysts hitherto known. They are furthermore hydrolytically and oxidatively stable, which makes them suitable for incorporation in alkaline detergent powder compositions without the risk of brown-staining.

With the present manganese complex bleach catalysts concentrated detergent powder compositions can be formulated having at least the same washing and bleaching power as the concentrated detergent powder compositions hitherto known.

The present invention also enables the formulation of concentrated detergent powder compositions having much better washing and bleaching performance at the lower temperature region, e.g. from 20°–60° C.

It should be appreciated that, by using such small amounts of catalysts according to the invention as compared with the use of about 2–10% by weight of a peroxyacid bleach precursor, a saving of weight percentage in the order of about 2–9% can be obtained, such that one can make the detergent powder more compact and just as powerful or with a much better bleaching and washing power.

The invention, however, is not limited to compositions containing the active manganese catalyst alone as a replacement for the peroxyacid bleach precursor. Compositions that contain a peroxygen compound and the above-described manganese complex catalyst and a peroxyacid bleach precursor are also within the purview of the present invention.

Processes for preparing concentrated and super-concentrated detergent powder compositions are known in the art and various improvements thereof are described in the patent literature, e.g. EP-A-0367339 (Unilever), EP-A-0390251(Unilever) and our co-pending GB Patent Applications N° 8922018.0 and N° 8924294.5.

The present invention is not concerned with these concentration and densifying production methods per se. The concentrated powder compositions of the invention can be obtained on the basis of any of the densifying and compacting methods known in the art; in such processes the bleach component including the catalyst is normally dry-mixed with the densified powder as one of the last steps of the manufacturing process. The invention is of particular advantage to concentrated detergent powder compositions having a bulk density within the range of from 650 g/l to about 1200 g/l, preferably form 750 g/l to 1000 g/l.

The Surface-Active Material

The surface-active material may be naturally derived, such as soap, or a synthetic material selected from anionic, nonionic, amphoteric, zwiterionic, cationic actives and mixtures thereof. Many suitable actives are commercially available and are fully described in literature, for example in "Surface Active Agents and Detergents", Volumes I and II, by Schwartz, Perry and Berch.

Typical synthetic anionic surface-actives are usually water-soluble alkali metal salts of organic sulphates and sulphonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those esters of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $C_{12}$ and then hydrolyzing with a base to produce a random sulphonate; sodium and ammonium $C_7$–$C_{12}$ dialkyl sulphosuccinates; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{10}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active compounds which may be used, preferably together with the anionic surface-active compounds, include in particular the reaction products of alkylene oxides, usually ethylene oxide, with alkyl ($C_6$–$C_{22}$) phenols, generally 5–25 EO, i.e. 5–25 units of ethylene oxides per molecule; the condensation products of aliphatic ($C_8$–$C_{18}$) primary or secondary linear or branched alcohols with ethylene oxide, generally 2–30 EO, and products made by condensation of ethylene oxide with the reaction products of propylene oxide and ethylene diamine. Other so-called nonionic surface-actives include alkyl polyglycosides, sugar esters, long-chain tertiary amine oxides, long-chain tertiary phosphine oxides and dialkyl sulphoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

As stated above, soaps may also be incorporated in the compositions of the invention, preferably at a level of less than 25% by weight. They are particularly useful at low levels in binary (soap/anionic) or ternary mixtures together with nonionic or mixed synthetic anionic and nonionic compounds. Soaps which are used are preferably the sodium, or, less desirably, potassium salts of saturated or unsaturated $C_{10}$–$C_{24}$ fatty acids or mixtures thereof. The amount of such soaps can be varied between about 0.5% and about 25% by weight, with lower amounts of about 0.5% to about 5% being generally sufficient for lather control. Amounts of soap between about 2% and about 20%, especially between about 5% and about 10%, are used to give a beneficial effect on detergency. This is particularly valuable in compositions used in hard water when the soap acts as a supplementary builder.

The Detergency Builder

Builder materials may be selected from 1) calcium sequestrant materials, 2) precipitating materials, 3) calcium ion-exchange materials and 4) mixtures thereof. Examples of calcium sequestrant builder materials include alkali metal polyphosphates, such as sodium tripolyphosphate; nitrilotriacetic acid and its water-soluble salts; the akali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. Nos. 4,144,226 and 4,146,495.

Examples of precipitating builder materials include sodium orthophosphate, sodium carbonate and long-chain fatty acid soaps.

Examples of calcium ion-exchange builder materials include the various types of water-insoluble crystalline or amorphous aluminosilicates, of which zeolites are the best known representatives, such as Zeolite (4) A, zeolite B or P, zeolite X, and also zeolite MAP (maximum aluminum P) as described in EP-A-384,070 (Unilever).

In particular, the compositions of the invention may contain any one of the organic or inorganic builder materials, though, for environmental reasons, phosphate builders are preferably omitted or only used in very small amounts.

Typical builders usable in the present invention are, for example, sodium carbonate, calcite/carbonate, the sodium salt of nitrilotriacetic acid, sodium citrate, carboxymethyloxy malonate, carboxymethyloxy succinate and the water-insoluble crystalline or amorphous aluminosilicate builder material, the latter being normally used as the main builder, either alone or in admixture with other builders or polymers as co-builder.

The Enzymes

The proteolytic enzymes which are suitable for use in the present invention are normally solid, catalytically active protein materials which degrade or alter protein types of stains when present as in fabric stains in a hydrolysis reaction. They may be of any suitable origin, such as vegetable, animal, bacterial or yeast origin. Proteolytic enzymes or proteases of various qualities and origins and having activity in various pH ranges of from 4–12 are available and can be used in the composition of the present invention. Examples of suitable proteolytic enzymes are the subtilisins which are obtained from particular strains of *B. subtilis* and *B. licheniformis*, such as the commercially available subtilisins Maxatase®, as supplied by Gist-Brocades, N.V., Delft, Holland, and Alcalase®, as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade names Esperase® and Savinase®. The preparation of these and analogous enzymes is described in British Patent Specification 1,243,784.

Other examples of suitable proteases are pepsin, trypsin, chymotrypsin, collagenase, keratinase, elastase, papain, bromelin, carboxypeptidases A and B, aminopeptidase and aspergillopeptidases A and B.

The amount of proteolytic enzymes normally used in the composition of the invention may range from 0.001% to 10% by weight, preferably from 0.01% to 5% by weight, depending upon their activity. They are generally incorporated in the form of granules, prills or "marumes" in an amount such that the final washing product has proteolytic activity of from about 2–20 Anson units per kilogram of final product.

Other enzymes, such as cellulases, lipases, cellulases and amylases, may also be used in addition to proteolytic enzymes as desired.

The Peroxygen Compound

The peroxygen compounds are normally compounds which are capable of yielding hydrogen peroxide in aqueous solution. Hydrogen peroxide sources are well known in the art. They include the alkali metal peroxides, organic peroxides such as urea peroxide, and inorganic persalts, such as the alkali metal perborates, percarbonates, perphosphates, persilicates and persulphates. Mixtures of two or more such compounds may also be suitable. Particularly preferred are sodium perborate tetrahydrate and, especially, sodium perborate monohydrate. Sodium perborate monohydrate is preferred because of its higher active oxygen content. Sodium percarbonate may also be preferred for environmental reasons.

Alkylhydroxy peroxides are another class of peroxygen compounds. Examples of these materials include cumene hydroperoxide and t-butyl hydroperoxide.

Organic peroxyacids may also be suitable as the peroxygen compound. Such materials normally have the general formula:

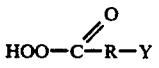

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a —COOH or C°—OOH group or a quaternary ammonium group.

Typical monoperoxy acids useful herein include, for example:

(i) peroxybenzoic acid and ring-substituted peroxybenzoic acids, e.g. peroxy-α-naphthoic acid;

(ii) aliphatic, substituted aliphatic and arylalkyl monoperoxyacids, e.g. peroxylauric acid, peroxystearic acid and N,N-phthaloylaminoperoxy caproic acid (PAP);

(iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassilic acid; diperoxysebasic acid and diperoxyisophthalic acid;

(vii) 2-decylperoxybutane-1,4-dioic acid;

(viii) 4,4'-sulphonylbisperoxybenzoic acid.

If organic peroxyacids are used as the peroxygen compound, the amount thereof will normally be within the range of about 2–10% by weight, preferably from 4–8% by weight.

All these peroxygen compounds may be utilized alone or in conjunction with a peroxyacid bleach precursor.

As already explained, peroxyacid bleach precursors are known and amply described in literature, such as in the GB Patents 836,988; 864,798; 907,356; 1,003,310 and 1,519,351; German Patent 3,337,921; Ep-A-0185522; Ep-A-0174132; Ep-A-0120591; and U.S. Pat. Nos. 1,246,339; 3,332,882; 4,128,494; 4,412,934 and 4,675,393.

Another useful class of peroxyacid bleach precursors is that of the quaternary ammonium substituted peroxyacid precursors as disclosed in U.S. Pat. Nos. 4,751,015 and 4,397,757, in EP-A-284292 and EP-A-331,229. Examples of peroxyacid bleach precursors of this class are:

2-(N,N,N-trimethyl ammonium) ethyl sodium-4-sulphophenyl carbonate chloride - (SPCC);

N-octyl,N,N-dimethyl-N10-carbophenoxy decyl ammonium chloride - (ODC);

3-(N,N,N-trimethyl ammonium) propyl sodium-4-sulphophenyl carboxylate; and

N,N,N-trimethyl ammonium toluyloxy benzene sulphonate.

Any one of these peroxyacid bleach precursors can be used in the present invention, though some may be more preferred than others.

Of the above classes of bleach precursors, the preferred classes are the esters, including acyl phenol sulphonates and acyl alkyl phenol sulphonates; acylamides; and the quaternary ammonium substituted peroxyacid precursors.

Highly preferred peroxyacid bleach precursors or activators include sodium-4-benzoyloxy benzene sulphonate (SBOBS); N,N,N',N'-tetraacetyl ethylene diamine (TAED); sodium-1-methyl-2-benzoyloxy benzene-4-sulphonate; sodium-4-methyl-3-benzoyloxy benzoate; SPCC trimethyl ammonium toluyloxy benzene sulphonate; sodium nonanoyloxybenzene sulphonate sodium 3,5,5,-trimethyl hexanoyloxybenzene sulphonate; penta acetyl glucose (PAG); octanoyl tetra acetyl glucose and benzoyl tetracetyl glucose.

These precursors may be used in an amount of about 1–8%, preferably from 2–5% by weight, of the composition. As further improvement the composition may also additionally include an organic bleach catalyst of the sulfonimine type as described in EP-A-0,446,982 and EP-A-0,453,002.

The Optional Ingredients

These are specific ingredients which are optionally and preferably included to give additional benefits and/or for aesthetical reasons. As such can be named, for example, optical whitening agents, anti-foaming agents, alkaline agents, anti-redeposition agents, stabilizers, anti-oxidants, fabric-softening agents, perfume and colouring agents. Other useful additives are polymeric materials, such as polyacrylic acid, polyethylene glycol and the co-polymers of (meth)acrylic acid and maleic acid, which may be incorporated to function as auxiliary builders together with any principal detergency builder or builder combinations, such as aluminosilicates, carbonates, citrates and the like. However, fillers and non-essential ballast ingredients, such as sodium sulphate, should be minimized to amounts that may be required only as process aids. Preferred compositions do not contain sodium sulphate.

Packaging

The composition of the invention is not only suitable for being presented in smaller packs for household and industrial use, but also in small unit-dose sachets (water-soluble, temperature release seal or tea-bag type) in a pack for convenient use without spilling.

The following non-limiting Examples will further illustrate the invention. Parts and percentages are by weight unless otherwise indicated.

EXAMPLE I

The following concentrated detergent base powder composition was prepared, using the method as described in EP-A-0 367 339 (Example 2) and had a bulk density of 900 g/l.

| Composition | % by weight |
|---|---|
| Alkyl benzene sulphonate | 9.8 |
| Nonionic surfactant[1)] | 13.1 |
| Sodium triphosphate | 40.9 |
| Sodium carbonate | 8.2 |
| CP5-polymer ex BASF[2)] | 1.7 |
| Alkaline sodium silicate | 7.4 |
| Minors | 1.6 |
| Moisture | 17.3 |

[1)]Ethoxylated alcohol (a mixture of Synperonic ® A3 and A7 ex ICI;
[2)]Co-polymer of maleic acid and acrylic acid having a molecular weight of about 70,000.

1) Ethoxylated alcohol (a mixture of Synperonic ® A3 and A7 ex ICI;

2) Co-polymer of maleic acid and acrylic acid having a molecular weight of about 70,000.

This powder was supplemented with 1.0% of proteolytic enzyme granules (Savinase ®), 1.0% anti-foam granules, 14% of sodium perborate monohydrate, perfume, and 0.04% of manganese complex catalyst of formula (1).

For easy handling, i.e. dosing, and stability, the manganese catalyst was added in the form of a granulate containing 2.0% active catalyst, 84.0% sodium sulphate and 4% of a sodium silicate coating.

The resulting powder was a highly concentrated fabric washing powder of excellent quality having a good washing and bleaching performance.

EXAMPLE II

The following detergent powder compositions having a bulk density of 610 g/l were prepared:

| | Nominal % by weight | |
|---|---|---|
| | II | A |
| Base powder composition | | |
| Sodium alkyl benzene sulphonate | 7.6 | 7.6 |
| Nonionic surfactant | 9.8 | 9.8 |
| Soap | 1.7 | 1.7 |
| Sodium aluminosilicate (zeolite) | 27.0 | 27.0 |
| Sodium carbonate | 13.0 | 13.0 |
| Alkaline sodium silicate (1:3.3) | 0.5 | 0.5 |
| CP5-polymer ex BASF | 4.0 | 4.0 |
| Sodium carboxymethylcellulose (SCMC) | 0.6 | 0.6 |
| Water | 11.0 | 11.0 |
| Minors | 1.5 | 1.5 |
| | 76.7 | 76.7 |
| Dry Additives | | |
| Sodium perborate monohydrate (PBM) | 14.0 | 14.0 |
| Enzyme (Savinase) | 1.1 | 1.1 |
| TAED granules (83%) | — | 7.4 |
| Ethylene diamine tetramethylene phosphonate (Dequest ®) - (33%) | — | 0.4 |
| Anti-foam granules | 0.4 | 0.4 |
| Manganese catalyst of formula 1 granules (2% active) | 2.0 | — |
| | 94.2 | 100.0 |

The above powders were used in a 40° C. cycle "Main-wash-only" washing machine test with a clean load and standard tea-stained test cloths. Each composition was dosed at 5 g/l product.

The bleaching performances were determined by measuring the reflectance of the test cloths before and after the wash in an Elrepho reflectometer apparatus.

The following results were obtained:

| | ΔR460* |
|---|---|
| Product II (14% PBM + 0.04% Mn-cat) | 14.5 |
| Product A (14% PBM + 6.1% TAED) | 10.6 |

Similar compositions as Product II were prepared but with reduced and increased PBM contents, i.e. 8.6% and 17.2%, making up to a total nominal % by weight for Product II' of 88.8% and for Product II" of 97.5%.

Washing test results with these products under the same above conditions were:

| | ΔR460* |
|---|---|
| Product II' (8.6% PBM + 0.04% Mn-cat) | 11.3 |
| Product II" (17.3% PBM + 0.04% Mn-cat) | 16.6 |

The above experiments show that even more concentrated powders can be obtained with superior performance to a current concentrated powder of the art (Product A) containing sodium perborate and TAED.

EXAMPLE III-VII

The following Examples illustrate some further highly concentrated detergent compositions within the purview of the invention:

| Powder Comp. | (Example) III | IV | V | VI | VII |
|---|---|---|---|---|---|
| | % by weight | | | | |
| Zeolite | 36.6 | 36.6 | 45.9 | 38.3 | 41.5 |
| Sodium carbonate | 15.0 | 15.0 | 13.3 | 16.6 | 14.4 |
| Soap | 0.7 | 0.7 | — | — | — |
| Sodium sulphate | 2.0 | 2.0 | — | — | — |
| SCMC | 0.9 | 0.9 | 0.9 | — | — |
| Fluorescer | 0.2 | 0.2 | 0.7 | — | — |
| Sodium alkylbenzene sulphonate | 23.3 | 23.3 | 13.6 | 23.3 | — |
| Primary alkyl sulphate | — | — | — | — | 23.1 |
| Nonionic 7 EO surfactant | 1.5 | 1.5 | 4.1 | — | 2.0 |
| Nonionic 3 EO surfactant | — | — | 7.0 | — | — |
| CP5 co-polymer ex BASF | 2.0 | 2.0 | 3.0 | 2.0 | 1.0 |
| Alkaline sodium silicate | 4.0 | 4.0 | — | 4.0 | 3.5 |
| Water | 13.8 | 13.8 | 11.5 | 15.8 | 14.5 |
| Total | 100.0 | 100.0 | 100.0 | 100.0 | 100.0 |
| Bulk density (g/l) | 805 | 867 | 840 | 811 | 868 |

One series of these powders was used as base powders, which were supplemented with 17.5% sodium perborate monohydrate and 0.04% manganese complex catalyst of formula 1 (i.e. 1% as granulates with 4% active catalyst content).

A second series of these powders was used as base powders, which were supplemented with 14% sodium perborate monohydrate, 2% TAED granules (83%) and 0.008% manganese complex catalyst of formula 1 (i.e. 0.5% as granulates with 1.6% active catalyst content).

All these powders showed excellent washing an bleaching performance, superior to comparative powders which were supplemented with 14% sodium perborate monohydrate and 7.4% TAED granules (83%) without the manganese complex catalyst.

EXAMPLE VIII

The following concentrated base powder composition was prepared, having a bulk density of 850 g/l.

| Base powder composition | Parts by weight |
|---|---|
| Primary alkyl sulphate | 6 |
| Nonionic surfactant | 13 |
| Zeolite AA (anhydrous basis) | 36 |
| Sodium citrate | 6 |
| Sodium carbonate | 15 |
| Sodium carboxymethyl cellulose | 0.7 |

One part of this composition was supplemented with 18% sodium perborate monohydrate (PBM) and 0.05% manganese complex catalyst of formula (1) added as 2% granules (2.5% active) - Composition VIII.

Another part of this composition was supplemented with 18% sodium perborate monohydrate, 8% TAED and 0.6% ethylene diamine tetra methylene phosphonate granules (33% active) as control composition B.

Both compositions VIII and B were used in a 40° C. Tergotometer heat-up washing test (25 minutes heat-up and 15 minutes at 40° C.) on standard tea-stained test cloths (dosage 4 g/l).

The following results were obtained:

| | ΔR460* |
|---|---|
| Composition VIII (18% PBM + 0.05% Mn-cat) | 12 |
| Control composition B (18% PBM + 8% TAED) | 6 |

We claim:

1. A concentrated detergent powder composition having a bulk density of above 600 g/l, comprising:
   (a) from 10 to 50% by weight, of a surface-active agent, selected from the group consisting of anionic, nonionic, cationic and amphoteric surfactants, and mixtures thereof;
   (b) from 15 to 80% by weight, of a detergency builder or builder mixture;
   (c) from 0 to 10% by weight, of an enzyme;
   (d) from 5 to 35% by weight, of a peroxygen compound, characterized in that the composition further contains from 0.0005 to 0.12% by weight, of manganese in the form of a manganese complex as bleach catalyst of the following formula:

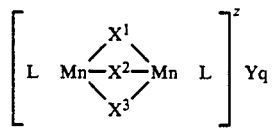

(I)

wherein Mn is manganese, which can be either in the II, III or IV oxidation state; $X^1$, $X^2$ and $X^3$ represent a bridging species selected from O, $O_2$, $HO_2$, OH, ROCOO and RCOO ions and mixtures thereof, with R being H, $C_1$–$C_4$ alkyl; z denotes the charge of the complex which can be positive or negative; if z is positive, Y is a counter-anion such as $Cl^-$, $Br^-$, $I^-$, $NO_3^-$, $ClO_4^-$, $NCS^-$, $PF_6^-$, $RSO_3^-$, $RSO_4^-$ or $OAc^-$, wherein R can be H or $C_1$–$C_4$ alkyl; if z is negative, Y is a counter-cation which can be an alkali metal, alkaline earth metal or (alkyl) ammonium cation; q=z/charge Y; and L is a ligand which is an organic compound selected from N, N',N''-trimethyl-triazacyclononane (Me-TACN) and its carbon-substituted derivatives having the formula:

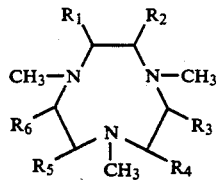

wherein $R_1$–$R_6$ can each be hydrogen or a $C_1$–$C_4$ alkyl group.

2. A composition according to claim 1, characterized in that said bleach catalyst has the formula:

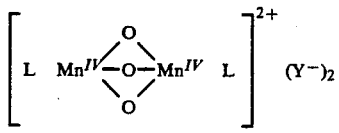

3. A composition according to claim 1, characterized in that said ligand is N, N', N''-trimethyltriazacyclononane.

4. A composition according to claim 1, characterized in that said ligand is 1, 2, 4, 7-tetramethyl-1, 4, 7-triazacyclononane.

5. A composition according to claim 2, characterized in that said bleach catalyst is:

$$[Mn^{IV}_2(\mu\text{—}O)_3(Me\text{—}TACN)_2](pF_6)_2$$

6. A composition according to claim 2, characterized in that said bleach catalyst is:

$$[Mn^{IV}_2(\mu\text{—}O)_3(MeMe\text{—}TACN)_2](PF_6)_2$$

7. A composition according to claim 1, characterized in that it has a bulk density of from 650 g/l to about 1200 g/l.

8. A composition according to claim 1, characterized in that said enzyme is selected from the group of proteolytic enzymes and lipolytic enzymes and mixtures thereof.

9. A composition according to claim 1, characterized in that said peroxygen compound is selected from the group consisting of alkalimetal peroxides, organic peroxides, inorganic persalts, alkylhydroxy peroxides, organic peroxyacids and mixtures thereof.

10. A composition according to claim 1, characterized in that it further comprises a peroxyacid bleach precursor.

11. A compositions according to claim 10, characterized in that it further comprises an organic bleach catalyst of the sulfonimine type.

* * * * *

UNITED STATES PATENT AND TRADEMARK OFFICE

CERTIFICATE OF CORRECTION

PATENT NO. : 5,227,084

DATED : July 13, 1993

INVENTOR(S) : Martens et al.

It is certified that error appears in the above-indentified patent and that said Letters Patent is hereby corrected as shown below:

On the title page, item [75] Inventors: the third inventor's name "Vliet van" should read -- van Vliet --.

Signed and Sealed this

Seventeenth Day of May, 1994

Bruce Lehman

*Attest:*

BRUCE LEHMAN

*Attesting Officer*

*Commissioner of Patents and Trademarks*